United States Patent [19]

Steele

[11] 4,158,930

[45] Jun. 26, 1979

[54] COMPOUND NUTATIONAL CARRIAGE MECHANISM

[76] Inventor: Robert L. Steele, 1505-44th St. NW., Washington, D.C. 20007

[21] Appl. No.: 848,682

[22] Filed: Nov. 4, 1977

[51] Int. Cl.[2] ..... A63H 3/22

[52] U.S. Cl. ..... 46/103; 46/149

[58] Field of Search ..... 46/1 R, 92, 97, 99, 46/103, 111, 116, 123, 124, 149, 201, 202

[56] References Cited

U.S. PATENT DOCUMENTS 1,608,648 11/1926 Dawley ..... 46/149

2,992,831 7/1961 Bennett ..... 46/149

FOREIGN PATENT DOCUMENTS 549077 11/1957 Canada ..... 46/149

913277 6/1954 Fed. Rep. of Germany ..... 46/149

*Primary Examiner*—Louis G. Mancene

*Assistant Examiner*—Robert F. Cutting

*Attorney, Agent, or Firm*—John J. Byrne

[57] ABSTRACT

A compound nutational carriage mechanism for a game, ambulatory toy or the like including a first disc member having a curvilinear periphery and a second disc member having a similar curvilinear periphery. The disc members are operably connected in such a manner that planar extensions of the disc members mutually intersect and form an angular relationship therebetween and the line of intersection of the planes extends perpendicular to a third plane. An axle is connected to the first and second disc members and lies in alignment with the line of intersection of the planar extentions of the first and second disc members.

15 Claims, 7 Drawing Figures

COMPOUND NUTATIONAL CARRIAGE MECHANISM

BACKGROUND OF THE INVENTION

This invention relates to a compound nutational carriage mechanism. More particularly the invention relates to a carriage mechanism for an ambulatory wobble toy, game or the like.

In the past games, toys, animal models etc. have been designed with various bearing elements and/or undercarriage mechanisms designed to impart a wobble or ambulatory motion to the article during operation. Such devices, while providing at least a degree of user appeal, exhibit several disadvantages. One difficulty is that in order to achieve a desired motion, prior devices have tended to be somewhat complex and intricate. Additionally previously known mechanisms are relatively costly to manufacture yet easily damaged. Once damaged these devices, are, in all practical respects difficult if not impossible to satisfactorily repair.

The difficulties suggested above are not intended to be exhaustive, but rather are among many which may tend to reduce the desirability of previously known devices. Other noteworthy problems may also exist; however, the foregoing is believed to demonstrate that previously known wobble carriage mechanisms will admit to worthwhile improvement.

Accordingly it is a general object of the invention to provide a novel carriage mechanism for a game, toy or the like which will obviate or minimize problems of the type previously described.

It is a particular object of the invention to provide a novel carriage mechanism for a game, ambulatory toy or the like which is basic in design and facilely manufactured.

It is another object of the invention to provide a wobble or compound nutational carriage mechanism which may be inexpensively manufactured, yet highly rugged and durable.

It is a further object of the invention to provide a novel wobble carriage mechanism which, if damaged, may be readily repaired.

It is yet another object of the invention to provide a novel compound nutational carriage mechanism which produces a realistic and appealing wobble motion to an ambulatory toy or the like.

THE DRAWINGS

Other objects and advantages of the present invention will become apparent from the following detailed description of a preferred embodiment taken in conjunction with the accompanying drawings wherein.

DETAILED DESCRIPTION

Figure 1:
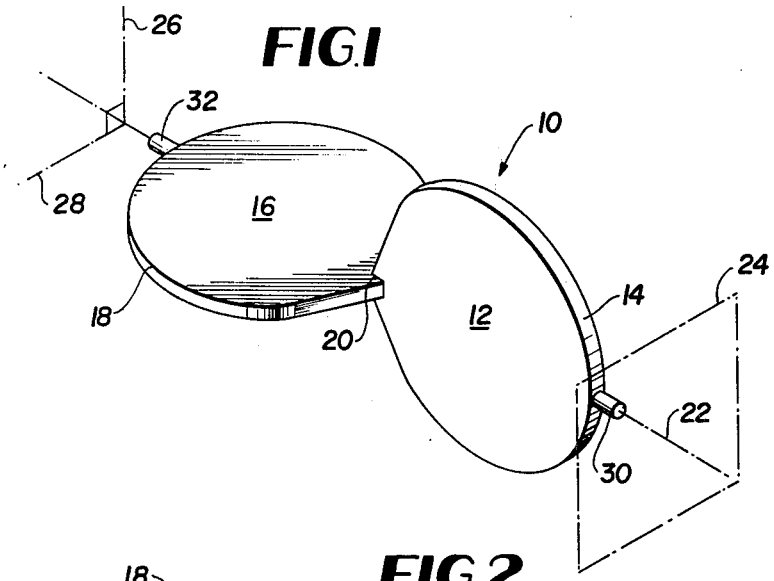
FIG. 1 is an axonometric view of a compound nutational carriage mechanism according to a preferred embodiment of the invention.

Referring now to the drawings and particularly FIG. 1, there will be seen an axonometric view of a compound nutational carriage mechanism 10 according to a preferred embodiment of the invention.

The carriage mechanism 10 includes a first disc member 12 having a generally regular curvilinear periphery 14 and a second disc member 16 having a similar curvilinear periphery 18.

The disc members 12 and 16 are interconnected through the provision of compatability dimension notches as at 20. An adhesive suitably bonds the abutting notches in a permanent, fixed relationship and thereby forms an inherent axle at the junction.

An imaginary planar extension through disc member 12 and an imaginary planar extension through disc member 16 intersect and form a line 22 extending through the central portion of the disc members and the center of the notches at 20. This line of intersection 22 lies perpendicular to a third plane 24 depicted by an outline in phantom on FIG. 1.

In a preferred embodiment the planar extension of disc members 12 and 16 are mutually perpendicular. In this regard a phantom line 26 lying in a planar extension of disc 12 and intersecting line 22 is perpendicular to a phantom line 28 lying in a planar extension of disc 16.

While a perpendicular angular relationship between the disc members is preferred other angular relationships may produce desirable results in some applications and are embraced by the subject invention.

In addition to the axle junction formed at 20 the traction disc members 12 and 16 are each fitted with an axle member 30 and 32 projecting outwardly from said disc members respectively. The axle members 30 and 32 as well as a central portion of disc notches at 20 lie upon the line upon the line of intersection 22 of said planar extensions.

Figure 2:
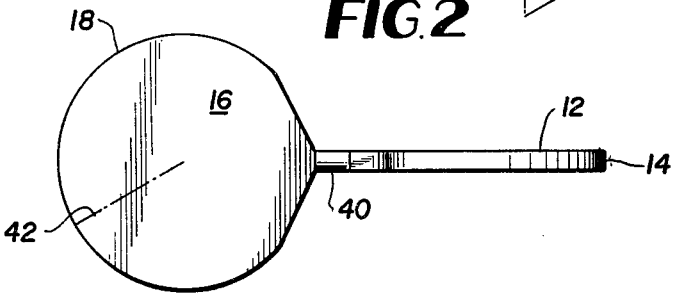
FIG. 2 is a plan view of the nutational carriage mechanism depicted in FIG. 1 with the addition of a distinct central axle member.

FIG. 2 discloses a modified embodiment of the structure depicted in FIG. 1 wherein discs 12 and 16 are spaced and a separate axle member 40 is interposed between and interconnects the disc members in an operative relationship. FIG. 2 also discloses the generally circular configuration of the disc members wherein the periphery of the discs lie upon the extremity of a constant radius line 42.

Figure 3:
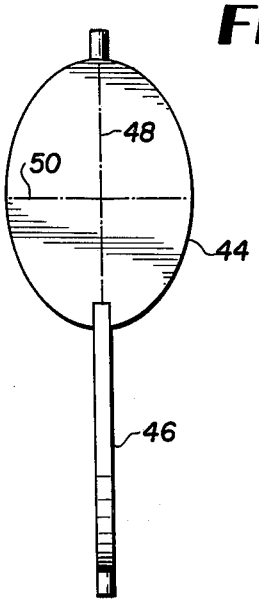
FIG. 3 is a plan view of another preferred embodiment of the invention wherein traction disc members are oblong in configuration.

An alternative preferred embodiment of the invention is set forth in FIG. 3 wherein the disc members 44 and 46 are each symmetrically configured with a major axis 48 and a minor axis 50.

In this embodiment the major axis 48 lies upon a line of intersection of planar extensions of the disc members 44 and 46. It will be noted additionally that the configuration of the disc members is not perfectly elliptical although such elliptical configuration would be satisfactory. The point to be made is that a variety of oblong configurations may be effectively utilized in the subject invention.

When the major axes are in alignment, as depicted in FIG. 3, the degree of compound nutational or wobble motion of the carriage mechanism will be less pronounced than that exhibited by the carriage mechanism depicted in FIG. 1.

Alternatively the disc members 44 and 46 may be constructed wherein the minor axes are in alignment and lie upon the intersection of planar extensions of the disc members. In this mode the major axes extend perpendicular to the line of intersection and produce the most pronounced nutational motion of the carriage mechanism.

Figure 4:
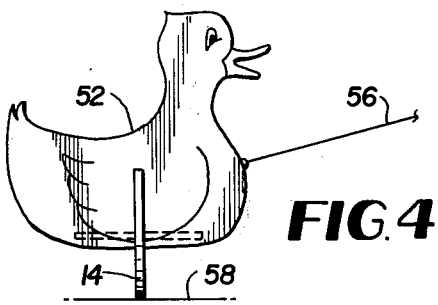
FIG. 4 is a side elevational view of the carriage mechanism depicted in FIG. 2 as employed with a generally planar ambulatory animal figure.
Figure 5:
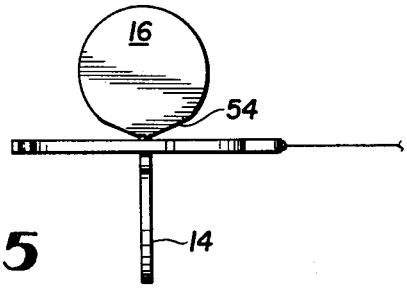
FIG. 5 is a top view of the structure depicted in FIG. 4.

FIGS. 4 and 5 disclose a generally planar animal model 52 mounted upon a carriage mechanism such as set forth in FIG. 2. In this connection the model 52 is supported upon the central axle member 40 as at 54. A flexible line or cord 56 is connected to a forward portion of the animal model and is used to pull the model across a ground surface 58.

Upon forward movement of the model 52 the supporting carriage mechanism will impart a side-to-side wobble motion to the model as the carriage mechanism rolls in a compound nutational mode across a ground surface.

Figure 6:
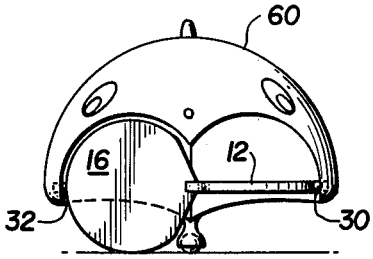
FIG. 6 is a front view of the carriage mechanism depicted in FIG. 1 as employed with a three dimensional ambulatory animal object.
Figure 7:
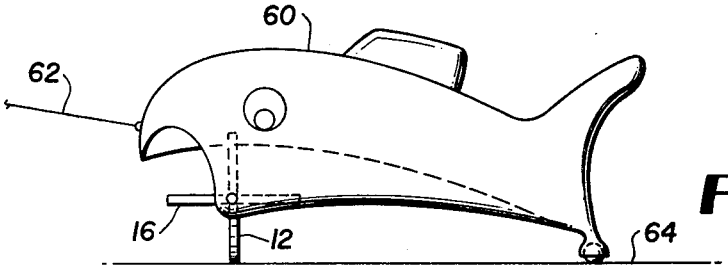
FIG. 7 is a side elevational view of the ambulatory toy depicted in FIG. 6.

In a similar vein FIGS. 6 and 7 disclose a carriage mechanism such as depicted in FIG. 1 mounted upon a three dimensional toy 60. In this embodiment the toy surrounds the carriage mechanism and is journaled upon axles 30 and 32 as previously described. A flexible line or cord 62 is connected to the nose of the toy and upon pulling motion by an operator serves to drag the toy across a ground surface 64.

In a manner as previously noted in connection with FIGS. 4 and 5 the carriage mechanism will exhibit a compound nutational motion as the toy is pulled forward which will produce a pronounced side-to-side wobble of the ambulatory toy.

From the foregoing description of a preferred embodiment of the invention, those skilled in the art will recognize several advantages thereof which singularly distinguishes the subject invention from previously known devices.

A particular advantage resides in the basic design concept of the compound nutational carriage mechanism which is facilely and inexpensively manufactured.

Additionally, the subject carriage mechanism is highly rugged and durable in operation.

Further the subject carriage mechanism may be quickly repaired in the event of excessive wear or damage during usage.

Another appealing feature of the subject carriage mechanism is that a highly realistic and appealing wobble motion is imparted to an associated ambulator toy, game or the like.

In describing the invention, reference has been made to preferred embodiments of the invention. Those skilled in the art, however, and familiar with the subject disclosure, may recognize additions, deletions, modifications, substitutions and/or other changes which will fall within the purview of the invention as defined in the following claims.

What is claimed is:

1. A compound nutational carriage mechanism for a game, ambulatory toy or the like comprising:

a first disc member having a curvilinear periphery;

a second disc member having a curvilinear periphery;

means interconnecting said first disc member with said second disc member wherein planar extensions of said first and second disc members mutually intersect and form an angular relationship therebetween and wherein concomitently the line of intersection of said planar extensions of said first and second disc members extends perpendicular to a third plane; and axle means connected to said first and second planar disc members and lying in coaxial alignment with the line of intersection of said planar extensions of said first and second disc members.

2. A compound nutational carriage mechanism for a game, ambulatory toy or the like as defined in claim 1 wherein:

said planar extensions of said first and second disc members are mutually perpendicular along said line of intersection.

3. A compound nutational carriage mechanism for a game, ambulatory toy or the like as defined in claim 1 wherein:

said first and second disc members having curvilinear peripheries are generally circular in configuration.

4. A compound nutational carriage mechanism for a game, ambulatory toy or the like as defined in claim 3 wherein:

said planar extensions of said first and second disc members are mutually perpendicular along said line of intersection.

5. A compound nutational carriage mechanism for a game, ambulatory toy or the like as defined in claim 1 wherein:

said first and second disc members each exhibit a generally symmetric configuration with a major axis and a minor axis and wherein the major axis of each disc member lies along the line of intersection of said planar extensions of said disc members and the minor axis of each disc member lies generally perpendicular thereto.

6. A compound nutational carriage mechanism for a game, ambulatory toy or the like as defined in claim 5 wherein:

said planar extensions of said first and second disc members are mutually perpendicular along said line of intersection.

7. A compound nutational carriage mechanism for a game, ambulatory toy or the like as defined in claim 1 wherein:

said first and second disc members each exhibit a generally symmetric configuration with a major axis and a minor axis and wherein the minor axis of each disc member lies along the line of intersection of said planar extensions of said disc members and the major axis of each disc member lies generally perpendicular thereto.

8. A compound nutational carriage mechanism for a game, ambulatory toy or the like as defined in claim 1 wherein:

said axle means extends between said first and second disc members for operably supporting an ambulatory toy between said disc members.

9. A compound nutational carriage mechanism for a game, ambulatory toy or the like as defined in claim 8 wherein:

said first and second disc members each exhibit a generally symmetric configuration with a major axis and a minor axis wherein one of said first and second disc members lie upon the intersection of said planar extensions of said disc members and the other of said major and minor axis of said first and second disc members lies generally perpendicular thereto.

10. A compound nutational carriage mechanism for a game, ambulatory toy or the like as defined in claim 9 wherein:

said planar extensions of said first and second disc members are mutually perpendicular along said line of intersection.

11. A compound nutational carriage mechanism for a game, ambulatory toy or the like as defined in claim 8 wherein:

said first and second disc members having curvilinear peripheries are generally circular in configuration.

12. A compound nutational carriage mechanism for a game, ambulatory toy or the like as defined in claim 1 wherein:

said axle means extend outwardly from each of said first and second disc members for operably supporting an ambulatory toy above said disc members.

13. A compound nutational carriage mechanism for a game, ambulatory toy or the like as defined in claim 12 wherein:

said first and second disc members each exhibit a generally symmetric configuration with a major axis and a minor axis wherein one of said first and second disc members lie upon the intersection of said planar extensions of said disc members and and the other of said major and minor axis of said first and second disc members lies generally perpendicular thereto.

14. A compound nutational carriage mechanism for a game, ambulatory toy or the like as defined in claim 13 wherein:

said planar extensions of said first and second disc members are mutually perpendicular along said line of intersection.

15. A compound nutational carriage mechanism for a game, ambulatory toy or the like as defined in claim 12 wherein: said first and second disc members having curvilinear peripheries are generally circular in configuration.

* * * * *